US005699658A

United States Patent [19]

Koltze et al.

[11] Patent Number: 5,699,658

[45] Date of Patent: Dec. 23, 1997

[54] POT SPINNING MACHINE

[75] Inventors: Karl Koltze, Mönchengladbach; Hans-Jürgen Heinrich, Röhrsdorf; Volker Roland, Weissbach; Peter Voidel, Chemnitz, all of Germany

[73] Assignee: W. Schlafhorst AG & Co., Monchen-Gladbach, Germany

[21] Appl. No.: 657,367

[22] Filed: Jun. 3, 1996

[30] Foreign Application Priority Data

Jun. 1, 1995 [DE] Germany ..... 195 20 153.1
Jun. 30, 1995 [DE] Germany ..... 195 23 937.7

[51] Int. Cl.[6] ..... D01H 1/08

[52] U.S. Cl. ..... 57/76; 57/312; 57/313

[58] Field of Search ..... 57/76, 312, 313, 57/264, 279

[56] References Cited

U.S. PATENT DOCUMENTS

| | | | |
|---|---|---|---|
| 802,161 | 10/1905 | Gill . | |
| 2,142,760 | 1/1939 | Prince-Smith | 57/312 |
| 2,291,819 | 8/1942 | McCann | 57/312 |
| 2,321,404 | 6/1943 | McCann . | |
| 2,520,078 | 8/1950 | Wright | 57/312 |
| 3,343,358 | 9/1967 | Nussbaum | 57/312 |
| 5,289,675 | 3/1994 | Brockmanns et al. | 57/312 |
| 5,448,880 | 9/1995 | Savinov et al. | 57/312 |

FOREIGN PATENT DOCUMENTS

| | | |
|---|---|---|
| 0 575 620 A1 | 12/1993 | European Pat. Off. . |
| 0 524 545 B1 | 8/1995 | European Pat. Off. . |
| 842 916 | 7/1952 | Germany . |
| GM 756 665 | 11/1957 | Germany . |
| 1 063 499 | 1/1960 | Germany . |
| 21834 | 9/1961 | Germany . |
| 58 022 | 9/1967 | Germany . |
| 76 25 081 | 8/1976 | Germany . |
| 26 21 900 A1 | 1/1977 | Germany . |
| 27 17 189 A1 | 11/1978 | Germany . |
| 41 03 771 A1 | 8/1992 | Germany . |
| 41 08 929 A1 | 9/1992 | Germany . |
| 42 06 031 A1 | 9/1993 | Germany . |
| 42 08 039 A1 | 9/1993 | Germany . |
| 42 36 379 A1 | 5/1994 | Germany . |
| 43 24 039 A1 | 1/1995 | Germany . |
| 348346 | 9/1960 | Switzerland . |
| 360004 | 3/1962 | Switzerland . |

*Primary Examiner*—Daniel P. Stodola
*Assistant Examiner*—Tina R. Taylor
*Attorney, Agent, or Firm*—Kennedy Covington Lobdell & Hickman, LLP

[57] ABSTRACT

A pot spinning machine holds a yarn rewinding tube in ready position during the spinning operation for immediate movement to an operative rewinding position in the event of a yarn break so that the broken end of yarn is not lost by winding onto the yarn cake already formed in the spinning pot and the yarn cake may then be properly rewound. The yarn break is detected with the aid of a yarn sensor which then emits a signal for immediately moving the rewinding tube into the rewinding position and clamping the yarn end. The rewinding operation can begin, even in the absence of a loose end of the yarn, if the yarn has assumed the form of a chord-like yarn segment extending substantially in the circumferential direction against the inner face of the yarn cake deposited onto the inside wall of the pot, which can be grasped and utilized to initiate the rewinding operation.

10 Claims, 3 Drawing Sheets

POT SPINNING MACHINE

FIELD OF THE INVENTION

The present invention relates to a pot spinning machines and methods utilizing spinning pots that rotate during spinning and rewinding, wherein the fiber material to be spun is delivered from a drafting arrangement to a tubular yarn guide associated with each spinning pot which delivers the spun yarn via a mouth in the yarn guide to progressively form a yarn cake in the spinning pot. After the conclusion of the spinning operation or upon a yarn break, the yarn cake must be wound up onto a rewinding tube held in readiness during spinning at the mouth of the yarn guide spaced apart from its rewinding position.

BACKGROUND OF THE INVENTION

Pot spinning is also known as centrifugal spinning, and hence the apparatus utilized for performing such spinning are referred to as pot or centrifugal spinning frames or machines. Such machines either have tubular pots both ends of which have openings of virtually equal size, suspended pots which have a downward opening on the underside of the pot for removing the spun yarn, or standing pots with an upward opening for removal of the spun yarn located at the top of the pot. Reference in this respect is made to German Patent Disclosure DE 41 08 929 A1. There are also pot spinning machines wherein, once the yarn cake in the pot has been finished, the yarn guide is first pulled out of the pot and a tube is then inserted into the pot to initiate the rewinding operation (see Swiss Patent CH 360 004). Other pot spinning machines have a cylindrical spinning pot open at the top and bottom, with a yarn guide introduced through the upper opening during spinning and with a corresponding bobbin tube inserted through the lower opening for rewinding (see German Patent Disclosure DE 43 24 039 A1). Finally, there are pot spinning machines in which the rewinding tube is predisposed in a ready position during spinning coaxially on the yarn guide or yarn guide tube. These machines may utilize either standing spinning pots or spinning pots that are cylindrical with openings at each end (see East German Patent DD 21 834 and German Patent Disclosure DE 43 24 039 A1).

There are also pot spinning machines with substantially cylindrical pots that lack any top and bottom, known as tube centrifuges, both ends of which have an opening of virtually the same size. Such tubular spinning pots may be magnetically-supported as in German Patent Disclosure DE 42 08 039 A1. According to German Patent Disclosure DE 43 24 039 A1, it is also possible with a standing tubular spinning pot of the kind known from East German Patent DD 21 834, that during spinning, the rewinding tube (onto which the yarn cake is to be wound) is predisposed on the tube of the yarn guide above the mouth thereof and locked thereat to prevent its being lowered. In this reserve position, the tube does not touch the rotating loose end of the yarn.

In these known cases, the rewinding tube can be held in readiness either above or below the spinning pot and thrust into the path of the loose end of the yarn as needed. If the rewinding tube is not thrust forward at the correct time in the event of a yarn break, then the torn end of the yarn in the pot runs along the inner wall of the yarn cake and can no longer be located and manipulated automatically with known devices. In that case, the rewinding operation can be initiated only from outside, generally manually, by relatively complicated procedures (see Swiss Patent CH 348 346 or German Patent DE 842 916).

In German Patent Disclosure DE 26 21 900 A1, an optical yarn monitor is disclosed to be located quite close to the point at which the yarn is created and records not only the presence but also the proper motion of the yarn. This known yarn monitor, which is preferentially used in ring spinning machines, is positioned adjacent an associated drafting arrangement at the base of the balloon forming above the spindle. The yarn sensor is intended to initiate protective provisions in the event of a yarn break, such as shutting off the following processing station.

As mentioned above, to initiate the rewinding operation, the rewinding tube is placed in the pot. In this connection, it has long been known for the loose end of the yarn furnished from the mouth of the yarn guide to be caught with the aid of a groove provided on the lengthwise end of the rewinding tube (see U.S. Pat. No. 802,161, page 2, lines 58/59). Mechanical means are also known for grasping the inner yarn layers of the yarn cake in the event of a yarn break, to enable the rewinding operation to be initiated, either by hand (see Swiss Patent CH 348 346, page 1, lines 18 ff.) or via a swiveling mechanism (see German Patent DE 842 916, page 4, lines 13–23).

In all of these known devices that initiate the rewinding operation after a yarn break, some layers of yarn are deposited randomly onto the rewinding tube which can lead to considerable problems in the later winding process in that it is generally not possible to unwind these random yarn layers from the tube. This produces additional waste, and the tubes require special cleaning.

In German Utility Model DE-GM 76 25 081, a tubular bobbin tube is disclosed that is entirely cylindrical and has a yarn catching slit with an associated yarn retaining element at a lengthwise end on the outer circumferential surface of the tube. A similar cylindrical bobbin tube with an encompassing yarn catching slit is disclosed in German Patent Disclosure DE 27 17 189 A1. In the latter case, the yarn catching slit may also be provided on the face-end edge of the tube (page 7, paragraph 4). A yarn catching slit with integrated yarn clamping means at a lengthwise end of a cylindrical bobbin tube is disclosed in European Patent Disclosure EP 0 524 545 B1. All of these known yarn catching slits are intended to be able to grasp and hold only a yarn that is pressed approximately radially with tension into the respective slit.

OBJECT AND SUMMARY OF THE INVENTION

In view of the above-described known pot spinning machines, it is an object of the present invention to provide a means to rescue or retrieve for purposes of further processing the already-spun yarn cake or the yarn contents of the centrifuge in a pot spinning machine, even in the event of a yarn break.

Basically, the present invention provides a yarn sensor associated with the transport path of the yarn in a pot spinning operation to detect the occurrence of a yarn break, and an associated means connected with the sensor for shifting the rewinding tube into a rewinding position when a yarn break is detected. Accordingly, when a yarn break during the pot spinning operation is detected by the yarn sensor, the rewinding tube may thereupon immediately be moved into its rewinding position, preferably with the broken yarn end being clamped at the same time, so that the yarn cake already located in the pot is immediate rewound to the rewinding tube. In this manner, the invention makes it possible to move the rewinding tube into its rewinding position before the broken yarn end has left the mouth of the yarn guide. As a result, it is assured that the contents of the pot will be rewound even if there is a yarn break, and that the yarn end cannot be deposited irretrievably on the yarn cake.

In the present invention, the rewinding tube is preferably locked on the tube of the yarn guide in a reserve position above the mouth of the yarn guide during the normal ongoing spinning operation. In the event of a yarn break, all that is needed to initiate rewinding is to release the locking means, so that the rewinding tube drops past the mouth of the yarn guide. Conversely, if the rewinding tube is normally located below the mouth of the yarn guide tube during the spinning operation, for instance, in the case of a suspended or tubular spinning pot, then the rewinding operation can likewise be initiated instantaneously in the event of a detected yarn break by quickly thrusting the rewinding tube upwardly beyond the yarn guide mouth. In both cases, the end of the rewinding tube adjacent to the yarn guide mouth should be held in readiness as close as possible to the mouth, so that the extraordinarily short time available from the time a yarn break is detected until the yarn end emerges from the mouth of the yarn guide will suffice to catch the yarn end for the sake of rewinding. For the above purpose, the adjacent end of the rewinding tube is positioned only far enough away from the yarn guide mouth as to not impede the operation of spinning or winding the yarn cake.

According to another aspect of the invention, the yarn sensor signal produced in the event of a yarn break is utilized to initiate not only the described movement of the rewinding tube past the yarn guide mouth, but also clamping of the broken yarn end in the region of the yarn guide tube or at the forward-moving end of the rewinding tube, so that continued rotation of the pot unchanged must necessarily rewind the yarn cake contained in the pot onto the tube.

Preferably, the rewinding tube is moved with sufficient quickness upon a yarn break to reach the rewinding position before the torn yarn end leaves the mouth of the yarn guide tube. Since only a fraction of a second is available for this purpose, it is advantageous if the yarn sensor is located upstream along the yarn path as far as possible in advance of the yarn guide mouth. A position in the vicinity of a preceding fiber drafting arrangement, i.e., immediately following the triangular conformation of the fibers being spun as they exit the drafting arrangement in direction of the yarn travel, is preferred. The fiber spinning triangle is not only located relatively far from the yarn guide mouth but also represents an especially difficult region in that yarn breaks during the spinning operation in pot spinning machines occur predominantly in the region of the spinning triangle. A yarn sensor disposed below the spinning triangle, preferably still upstream of the adjacent entrance to the yarn guide tube, can therefore detect a yarn break quickly enough that the rewinding tube may be brought into its rewinding position long before the yarn end leaves the mouth of the yarn guide tube, so that the still-rotating loose end of the yarn may be fixed in notches or clamping devices at the base of the rewinding tube.

Because of this provision for the early detection of a yarn break in the same region where such breaks typically occur, enough time remains to initiate the associated emergency provision of rapidly raising or lowering of the rewinding tube from the reserve position held in readiness above or below the spinning pot into the rewinding position. From an energy standpoint, it is more favorable to allow a tube to drop rather than to raise the tube, it is preferable for the rewinding tube to be held in readiness in an upper position on the tube of the yarn guide above the yarn guide mouth.

In this reserve position, the rewinding tube can be fixed, for instance with the aid of a magnet. Since the release of a thusly suspended rewinding tube can occur very quickly, and the distance the tube must travel from the reserve position to the rewinding position is short, the rewinding operation can be initiated virtually instantaneously, not only at the end of yarn cake buildup but in the interim as well in the event of a yarn break or some other interruption in the spinning operation. Almost equally quickly, a rewinding tube held ready below the yarn guide mouth can be raised from its reserve position to the rewinding position, for instance by spring force.

According to a further feature of the invention, the described reserve position of the rewinding tube on the yarn guide enables not only a yarn break to be detected quickly by the yarn sensor and the direct release of the rewinding tube thereupon, but also accomplishes the particular advantage of enabling the locking of the rewinding tube to be designed such that upon its release the rewinding tube simultaneously clamps the yarn end sliding through the yarn guide tube, preferably by means of one and the same motion. In other words, one and the same mechanism, such as a control magnet initiated by the yarn sensor, locks the rewinding tube in the reserve position, and in the other position it clamps the yarn end sliding through the tube of the yarn guide.

In a particular embodiment of the invention, provision is made for initiating the rewinding operation, especially after a yarn break, even if there is no longer any revolving loose end of the yarn between the yarn guide mouth and the yarn cake such that all the fiber material deposited in the spinning pot or centrifuge is wound onto the rewinding tube and later can be unwound from it again without any loss. In normal spinning operation, a loose end of the yarn extends radially between the mouth of the yarn guide tube and the spun yarn cake. However, in the event this loose end of yarn is no longer available, the present invention advantageously serves instead to initiate the rewinding operation by utilizing a different starting length of yarn, namely a length of yarn that has already left the deposition path radially extending from the yarn guide and has already applied itself loosely to the inner wall of the yarn cake. Specifically, the rewinding operation may be initiated utilizing a broken yarn end that has been applied to the inner wall of the yarn cake not exactly circularly but rather partly in the orientation of a chord relative to the interior of the pot and which therefore extends essentially in a radial plane of the pot approximately along the circumference of the rewinding tube.

According to a further feature of the invention, at least one of the lengthwise ends of the rewinding tube has a radially protruding flanged portion with a yarn catching notch therein partially covered by a spring element, the widened portion being positioned to project into close adjacency with the yarn cake almost close enough to touch the inside surface of the yarn cake. As a result, a yarn chord segment utilized such as above-mentioned for initiating the rewinding operation will extend essentially parallel to the circumferential direction, or in the plane of, the radially protruding widened portion and can be firmly retained.

This outcome is surprising. Conventional catching notches on rewinding tubes are known not to be able to properly hold a chord-like yarn end firmly and to use such a yarn end for ordered rewinding of a yarn cake. This is because the applicable chord-like yarn segment rests only loosely and without tension (in the radial plane of the catching means) on the inside face of the yarn cake. The known catching means are designed such that the chord segment, if it is touched at all, passes only loosely through the yarn catching notch.

However, the functional integration of the characteristics preferably employed to construct the present apparatus, namely the maximum possible radius of the radially protruding widened end portion of the rewinding tube, the catching notch located on the edge of the widened end portion, and the spring element of the catching notch, lead to complete success that could not have been expected in advance from these individual characteristics.

As noted, it is preferably provided that the catching notch is positioned as close as possible to the inside diameter of the yarn cake, so that it can reliably grasp any chord-like yarn segment that develops. In accordance with a preferred embodiment, it is especially favorable for the plate-like widened portion to be inwardly recessed at its axial end face for receiving the spring element, and for the spring element to partially cover the catching notch at a distance, measured from the axial end of the widened portion, that is equal to or greater than a yarn diameter. A snap ring is preferably provided as the spring element.

Thus, the present invention accomplishes a pot spinning method by which it is assured that the yarn cake in the spinning pot will be automatically rewound properly even in the event of a yarn break, without requiring a search for the yarn end on the yarn cake. That is, in the event of a yarn break, if against expectation the loose end of the yarn extending from the yarn guide mouth to the yarn cake should prove not to have been grasped, then the present invention assures by means of the method carried out by the described apparatus that a yarn end applied circumferentially in the form of a yarn chord segment onto the inside face of the yarn cake is utilized to initiate the rewinding operation. Various conventional devices are possible as the yarn sensor, which by way of example may function optically or capacitively. One example of an optical yarn sensor or yarn monitor is disclosed in German Patent Disclosure DE 26 21 900 A1.

The invention will be described below in further detail in terms of the exemplary embodiments shown in the drawings.

DESCRIPTION OF THE PREFERRED EMBODIMENTS

Figure 1:
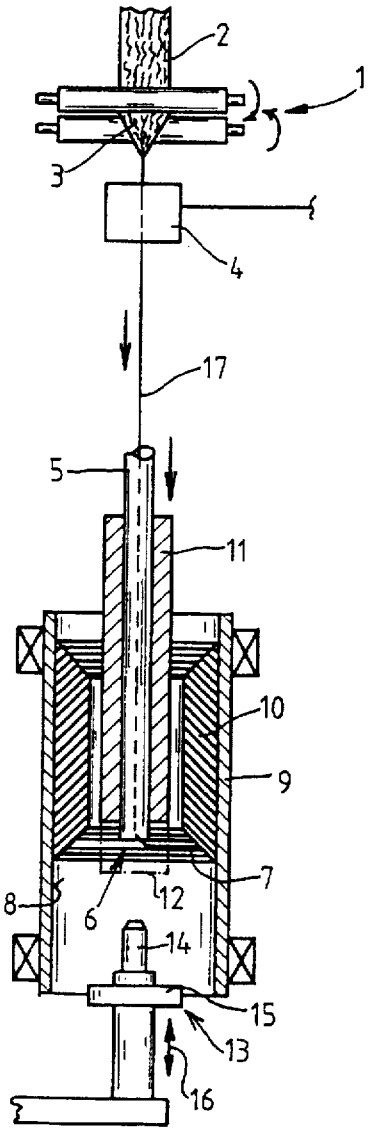
FIGS. 1 and 1*a* are vertical longitudinal sections through a pot spinning station according to the present invention, shown in the spinning position.

Referring now to the accompanying drawings and initially to FIG. 1, a representative spinning station of a pot spinning machine is shown. In advance of the spinning pot is a drafting arrangement 1, typically having a series of drafting roller pairs but symbolized in FIG. 1 only by the last pair of drafting rollers, wherein a sliver 2 is drawn and as it emerges from the last roller pair is twisted under the influence of the revolving spinning pot 9 so as to converge in a spinning triangle 3 into a yarn 17. The yarn 17 then immediately passes through a yarn sensor 4 located directly following the spinning triangle 3 and enters an entrance end to a tubular yarn guide 5. The yarn 17 emerging from the exit mouth 6 of the yarn guide 5 is applied to the inner wall 8 of the spinning pot 9 and wraps centrifugally thereagainst to progressively form a yarn cake 10. During the spinning operation, a rewinding tube 11 is located coaxially on the yarn guide 5, immediately above and spaced from its mouth 6, from which position the rewinding tube 11 can be lowered past the mouth 6 of the yarn guide 5 to initiate a rewinding operation (as indicated by the position 12 shown in broken lines and discussed more fully below).

A rewinding operation may be initiated for several reasons. On the one hand, if the yarn cake 10 in the spinning pot 9 has been completed, or on the other hand, if an interruption in the spinning operation has occurred, for instance from yarn breakage, rewinding will be initiated. The base of the rewinding tube preferably has suitable clamping or retaining devices. Thus, when the rewinding tube 11 is lowered outwardly past the mouth 6 of the yarn guide 5 into the rewinding position 12 shown in broken lines, the rotating loose trailing end 7 of the yarn 17 forming the yarn cake in the spinning pot can be grasped by clamping or retaining devices and fixed such that the yarn cake 10 is automatically or by compulsion wound onto the rewinding tube 11 as the spinning pot 9 continues to rotate.

The rewinding tube 11, once wound with the yarn from yarn cake in the spinning pot, can then be transferred to a caddy 13, having a flat base 15 and an upstanding spindle 14 for coaxially supporting the rewinding tube 11, that is held ready at a suitable spacing below the spinning pot 9. After being lowered in the direction of the arrow 16, the wound tube 11 can be carried away together with the caddy 13 for further processing, while a new empty tube is brought with a further caddy (not shown) and fixed below the yarn guide 5 in the reserve position.

Figure 2:
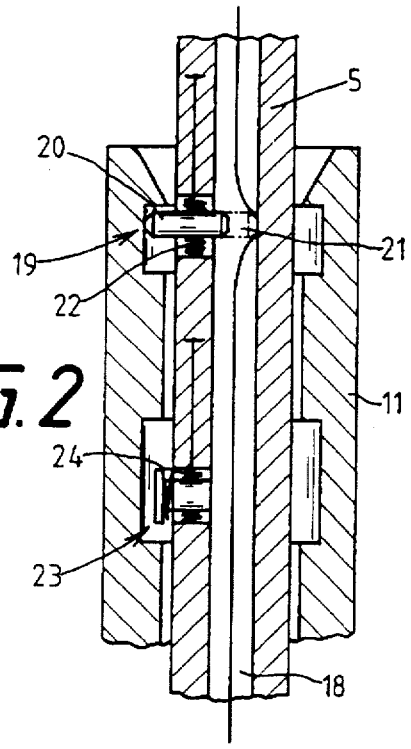
FIG. 2 shows a device for locking the rewinding tube on the yarn guide in the pot spinning station of FIGS. 1 and 1*a;*

The rewinding tube 11 is held in the reserve position on the yarn guide 5 above its exit mouth 6 during normal ongoing centrifugal winding of the yarn cake in the spinning pot by a locking means 19 shown in FIG. 2. If the yarn sensor 4 detects a yarn break, the yarn sensor 4 transmits a signal to the locking means 19 to release the rewinding tube 11. The locking means 19 thereupon disengages from the rewinding tube 11, so that the rewinding tube 11 drops downwardly and the rewinding operation is initiated. For initiating the rewinding operation, it is advantageous if the rotating loose end 7 of the yarn between the yarn guide mouth 6 and the yarn cake 10 has a sufficient tension to catch the yarn end on the tube and fix it. An adequate tension for this purpose may under some circumstances already exist if the yarn end is long enough. It is especially advantageous, however, for the yarn end to be clamped or otherwise firmly held or caught and for the rewinding operation to be initiated immediately thereafter.

The locking means 19 shown in FIG. 2 is a preferred exemplary embodiment that is suitable both for keeping the rewinding tube 11 in its reserve position on the tube of the yarn guide 5 and in the event of a yarn break, by switchover of the locking means, for clamping the yarn 17 or its trailing yarn end, in the axial interior channel 18 of the yarn guide 5. To that end, the locking means 19 includes an electromagnet 22 which is switchable by the supply of electrical current to its electromagnetic windings in response to signals furnished by the yarn sensor 4 to act upon and displace a locking pin 20 or the like to move between the position indicated by solid lines, wherein the pin 20 extends radially outwardly into engagement within an interior recess in the rewinding tube 11 to lock the rewinding tube 11 in its reserve position, and a position 21 represented by broken lines, wherein the locking pin 20 extends radially inwardly into the channel 18 of the yarn guide 5 into clamping engagement with the yarn end 17 therein. During a switchover from the tube locking position to the yarn clamping position, the rewinding tube 11 is released to slide downwardly into its rewinding position which is predetermined by means of a stop 23 affixed to the yarn guide 5 that is preferably biased outwardly by spring force to engage in another interior recess within the rewinding tube 11 as it drops into the rewinding position. It is equally possible for the stop 23 to have an electromagnetic drive 24, to enable the stop 23 to be retracted and the rewinding tube 11 thus to be released.

Figure 3:
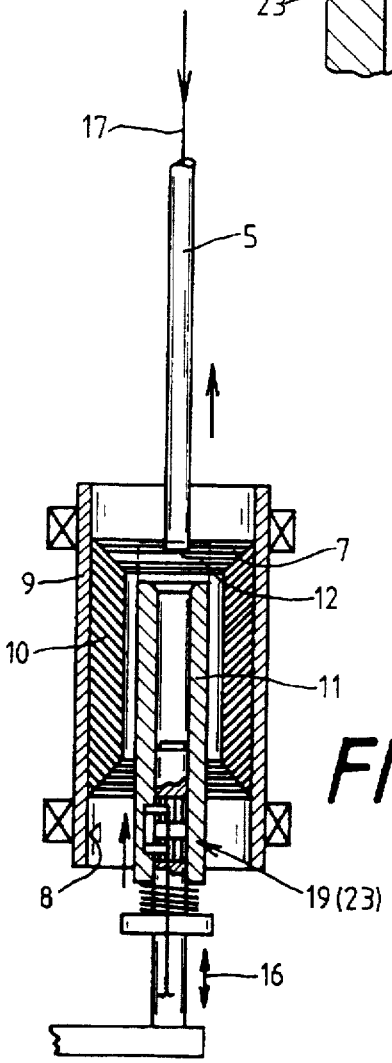
FIG. 3 shows an alternative embodiment of pot spinning station having a rewinding tube that can be inserted from below the spinning pot.

FIG. 3 shows another embodiment of a spinning station of a pot spinning machine, which is substantially identical to the spinning station of FIG. 1 except that, in this embodiment, the rewinding tube 11 is introduced into the spinning pot from beneath.

In pot spinning machines according to the present invention in which the rewinding tube is already held in readiness in a reserve position during the spinning operation so that the rewinding tube can be immediately brought to the rewinding position, the rewinding tube should be moved into the rewinding position in the event of a yarn break so quickly that the yarn cake already formed in the spinning pot can still be properly rewound. Thus, according to the present invention, the yarn break is detected with the aid of the yarn sensor 4, which thereupon sends a signal for instantaneously moving the rewinding tube into the rewinding position and for clamping the yarn end.

Figure 1A:
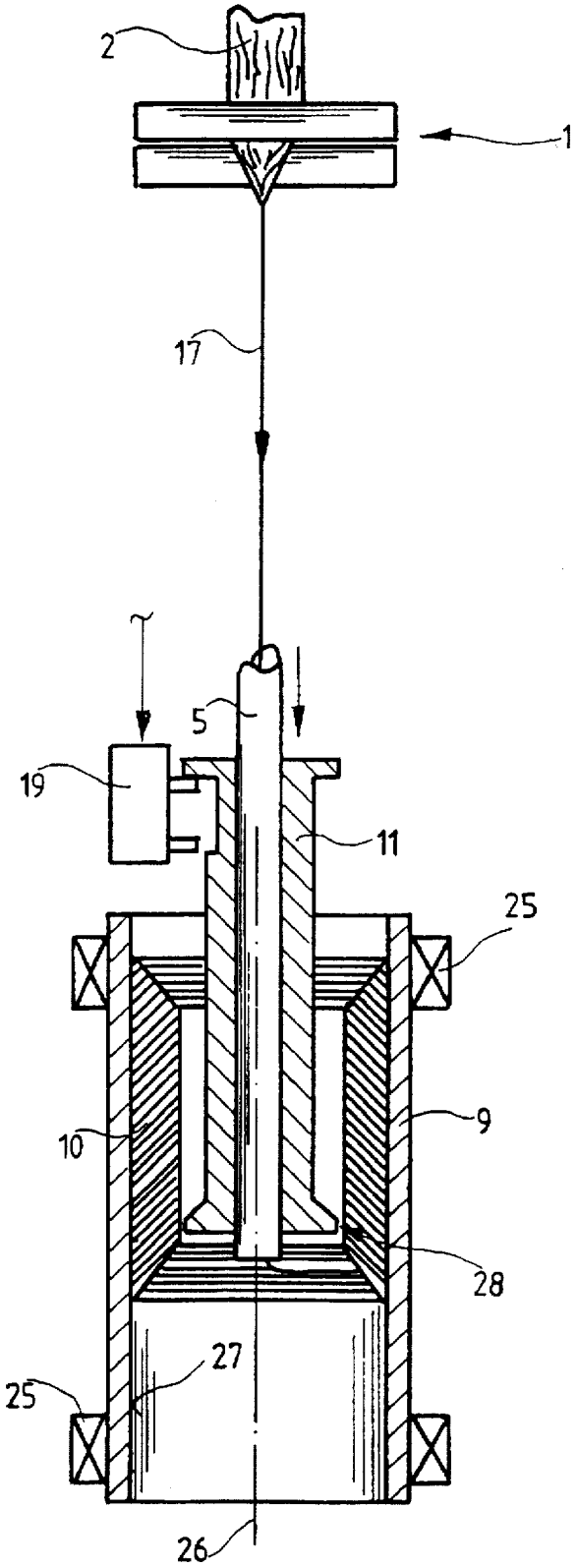

FIG. 1A schematically shows a spinning station of another pot spinning machine wherein a spinning pot 9 rotates in bearings 25 about an axis 26. The type of bearings are of no significance with respect to the present invention; however, it is known to use magnet bearings, for instance to support single-motor-driven spinning pots.

A sliver drawing device, such as a drafting mechanism 1 to which is supplied a sliver 2, is installed above the spinning pot 9. The yarn 17 created by the action of the revolving spinning pot 9 is applied into the interior of the spinning pot 9 via a yarn guide tube 5 supported for axial movement and the yarn is thereby wrapped centrifugally onto the inner wall 27 of the rotating spinning pot, forming a yarn cake 10.

A rewinding tube 11 is fixed in a ready position on the yarn guide tube 5 by means of a latching device 19, which is triggerable in a defined fashion to shift the rewinding tube 11 downwardly beyond the mouth of the yarn guide 5 into a rewinding position (not shown).

Figure 4:
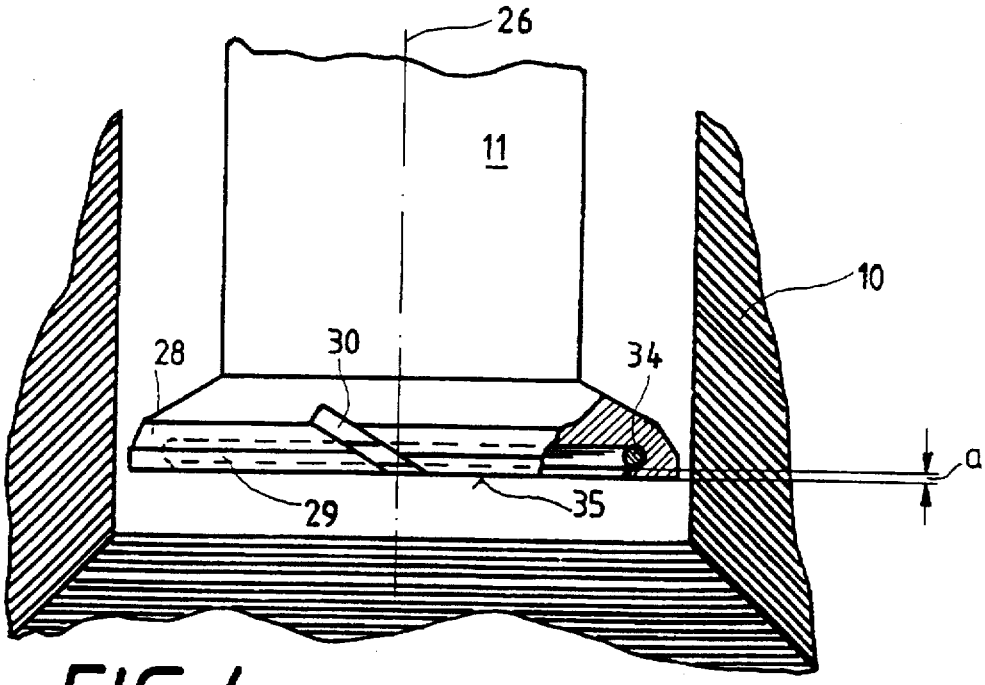
FIG. 4 is a detailed view of one end of the rewinding tube according to the present invention on a larger scale.
Figure 5:
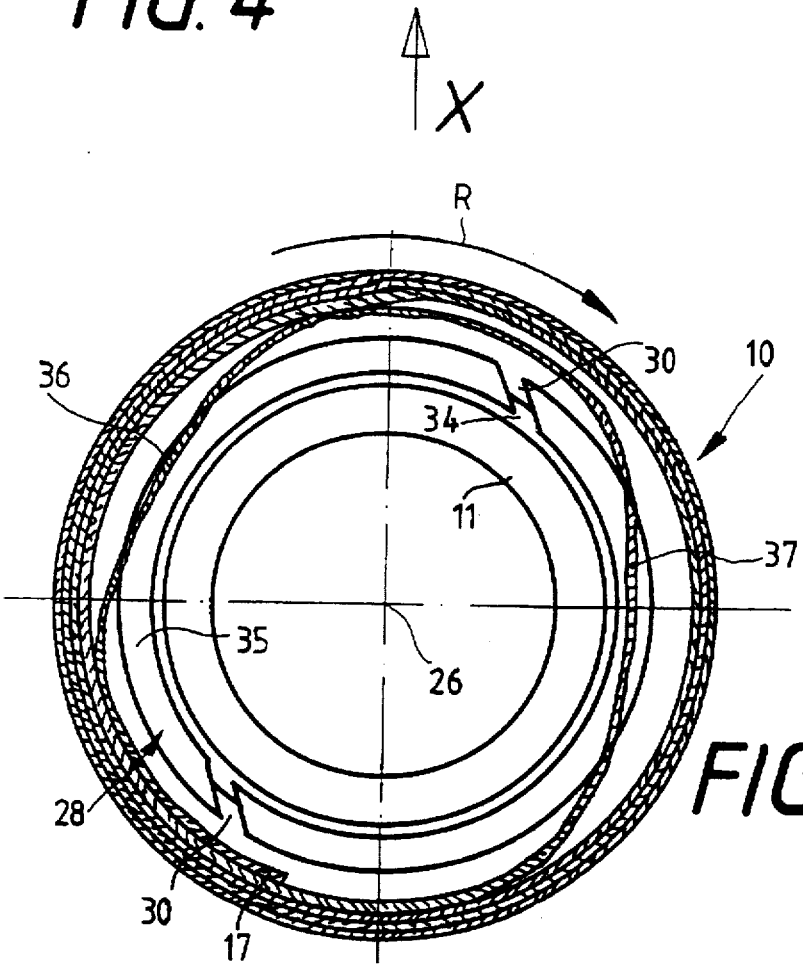
FIG. 5 shows the rewinding tube of FIG. 4 in the direction of the arrow X of FIG. 4.

As can be seen from FIGS. 4 and 5, the rewinding tube 11 has a flange-like portion 28 projecting radially outwardly from its lower end, with at least one yarn catching notch 30 formed in the flange 28. The radial flanged portion 28 is recessed on its interior to receive a spring element 34, preferably embodied as a snap ring or the like, that partially covers the yarn catching notch 30 at a distance a from the lower edge 35. The distance a should preferably be the same as or greater than the diameter of the yarn to be caught.

In the event of a yarn break below the yarn sensor 4, the trailing yarn end that emerges from the mouth of the yarn guide 5 is not as a rule applied securely flush against the annular interior surface of the yarn cake 10 but instead loosely forms in chord-like segments 36, 37 relative to the previously wound layers of the yarn cake 10. If such a chord-like segment 36 or 37 of a yarn end located on the yarn cake 10 enters the region of the radial flange portion 28 of the rewinding tube 11, then as the spinning pot continues rotating the notch 30 acts as a yarn catching device in which the chord-like yarn segment becomes engaged to be grasped and clamped by the spring element 34, without any necessity for the yarn segment to have been tensioned or otherwise held taut beforehand. Because the spinning pot continues rotating during this yarn end catching operation, a rewinding operation is automatically initiated causing the entire yarn cake 10 deposited in the spinning pot to then be wound in ordered fashion onto the rewinding tube 11 for subsequent unwinding from the tube 11 without loss.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A pot spinning machine, comprising a spinning pot for rotation during spinning and rewinding, a tubular yarn guide associated with the spinning pot disposed for receiving from a drafting arrangement the fiber material to be spun and having a mouth operable to deliver spun yarn into the spinning pot to form a yarn cake therein, a rewinding tube movable between a reserve position during spinning at the mouth of the yarn guide and a rewinding position spaced from the yarn guide for winding onto the rewinding tube the yarn cake after the conclusion of the spinning operation, a yarn sensor for detecting a yarn break along the transport path of the yarn, and means connected to and automatically responsive to a signal produced by the yarn sensor for shifting the rewinding tube from its reserve position into its rewinding position.

2. The pot spinning machine of claim 1, wherein the tube shifting means includes means for clamping the broken yarn end.

3. The pot spinning machine of claim 2, wherein the tube shifting means comprises locking means for fixing the rewinding tube in its reserve position and for releasing the rewinding tube and simultaneously clamping the yarn in the channel of the yarn guide in one motion.

4. The pot spinning machine of claim 1, wherein the yarn sensor is positioned downstream and immediately adjacent a fiber drafting location of the drafting arrangement.

5. The pot spinning machine of claim 1, wherein the yarn guide tube is disposed closely adjacent an operative end of the rewinding tube for movement thereof to initiate rewinding and the operative end of the rewinding tube comprises a yarn catching device.

6. The pot spinning machine of claim 1, wherein the rewinding tube has a lengthwise end comprising a radially widened portion with a yarn catching and clamping assembly positioned closely adjacent the inside diameter of the yarn cake.

7. The pot spinning machine of claim 6, wherein the yarn catching and clamping means comprises a yarn catching notch and a spring element partially covering the catching notch inwardly of the rewinding tube.

8. The pot spinning machine of claim 7, wherein the radially widened portion of the rewinding tube comprises a recess for receiving the spring element so as to partially cover the catching notch at a distance from the lengthwise end of the rewinding tube at least equal to a yarn diameter.

9. The pot spinning machine of claim 7, wherein the spring element comprises a snap ring.

10. In a pot spinning method comprising delivering fiber material to be spun through a mouth of a tubular yarn guide into a rotating spinning pot for forming a yarn cake therein and subsequently rewinding the yarn cake onto a rewinding tube, maintaining the rewinding tube during spinning at a reserve position at the mouth of the yarn guide and moving the rewinding tube into a rewinding position spaced from the yarn guide for rewinding thereunto the yarn cake after the conclusion of the spinning operation, the improvement comprising the steps of detecting a yarn break occurring during the spinning operation along the transport path of the yarn and producing a signal in response to the yarn break, automatically moving the rewinding tube into its spaced rewinding position for rewinding thereunto the yarn cake in response to the signal, and simultaneously clamping the broken yarn end inside the yarn guide.

* * * * *